United States Patent [19]

van Breems

[11] Patent Number: 4,688,506

[45] Date of Patent: Aug. 25, 1987

[54] BOAT SAIL CONTROL SYSTEM

[76] Inventor: Martinus van Breems, 2 Manitou Ct., Westport, Conn. 06880

[21] Appl. No.: 771,673

[22] Filed: Sep. 3, 1985

[51] Int. Cl.[4] ..... B63H 9/06

[52] U.S. Cl. ..... 114/104; 114/105; 114/108

[58] Field of Search ..... 114/102–115, 114/39; 160/84 R

[56] References Cited

U.S. PATENT DOCUMENTS

| | | | |
|---|---|---|---|
| 2,247,219 | 6/1941 | Childs | 114/104 |
| 3,734,809 | 5/1973 | Ellis | 160/84 R |
| 3,913,655 | 10/1975 | Ogins | 160/84 R |
| 4,388,888 | 6/1983 | Gushurst | 114/104 |
| 4,444,238 | 4/1984 | Adler | 160/84 R |
| 4,469,040 | 9/1984 | Gougeon | 114/104 |
| 4,487,147 | 12/1984 | Hoyt | 114/104 |
| 4,544,011 | 10/1985 | Sawamura | 160/84 R |

FOREIGN PATENT DOCUMENTS

| | | | |
|---|---|---|---|
| 2441539 | 6/1980 | France | 114/104 |

*Primary Examiner*—Joseph F. Peters, Jr.
*Assistant Examiner*—Clifford T. Bartz
*Attorney, Agent, or Firm*—Epstein & Edell

[57] ABSTRACT

System for controlling a boat sail as it is dropped, the sail being made of flexible material and being folded to lie when it is a mainsail, for example, on top of the boom of the boat. One or more control lines run parallel to the mast from the boom to a topping lift. The control lines run through grommets in the sail, the grommets being disposed in horizontal alignment with respective sliding fastening means by which the sail is attached to the mast. Equidistant between each pair of successive horizontal rows of grommets and the respective sail fastening means aligned therewith there is a batten which extends from the leading edge to the trailing edge of the sail. The control lines run through successive vertically aligned grommets so as to lie alternately on one side and then the other side of the sail. As the sail is dropped, the control lines force the sail to be folded at the locations of the battens into a plurality of panels which lie atop the boom, successive battens being disposed on opposite sides of the boom.

9 Claims, 4 Drawing Figures

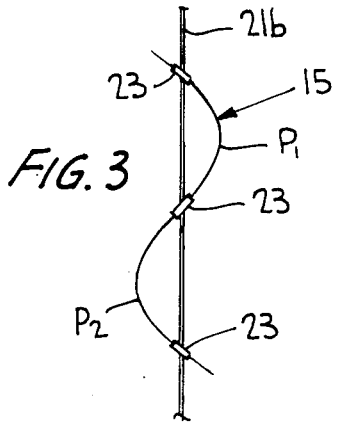
FIG. 3
FIG. 2
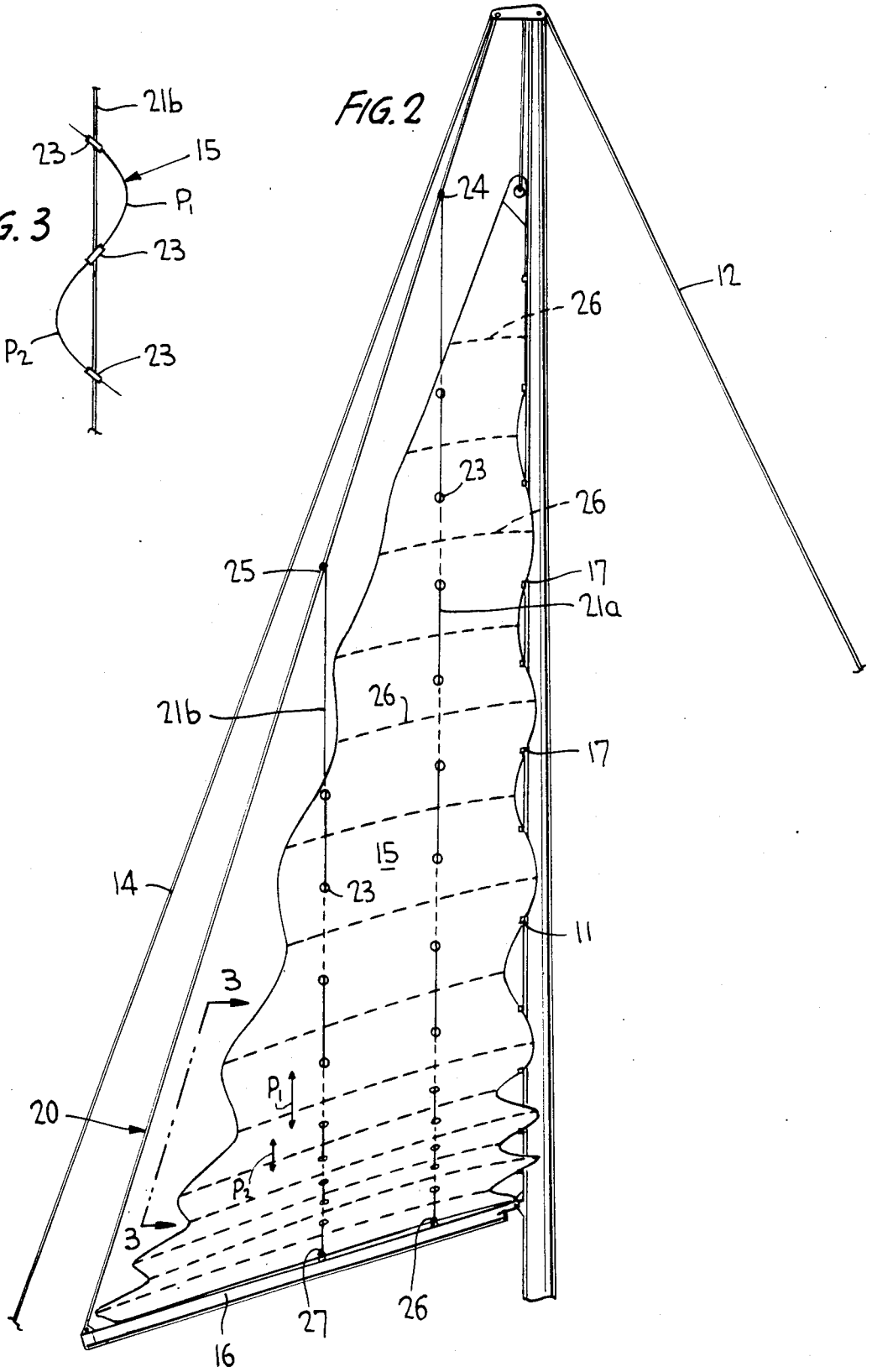

BOAT SAIL CONTROL SYSTEM

This invention relates to a system for controlling a boat sail as it is dropped. Traditionally, as a sail is dropped, it falls over the deck of the boat. If the sail is a mainsail, it must be rolled or folded up on top of the boom. If it is a jib, it is preferably rolled up or folded before it falls onto the deck. In accordance with the sail control system of the invention, the sail is automatically folded as it is dropped, instead of being collected into a pile or rolled up as in a number of prior art sail control systems.

In accordance with one such prior art sail control system, several lines are fastened on both sides of the mast and to both sides of the boom. These lines, known as lazy jacks, collect the sail as it is dropped. The sail must then be rolled or folded up.

Other prior art sail control systems including the "zip stop system", which zips the sail up into a bag which is located along the mast, and roller furling systems, which roll the sail up, either inside or just outside the mast. One such system, sold by Hood, rolls the sail up inside a special boom. All of the above prior art sail control systems which roll or fold the sail up are quite expensive, ranging in price from $2,000 to over $5,000 for a 36' sailboat. In addition, they are complicated, can fail at an inopportune moment, and can adversely affect the performance of the sail.

In accordance with the present invention, there are provided one, two, three or more control lines which run parallel to the mast from the boom to a topping lift; a topping lift is a line that is run from the top of the mast to the end of the boom. The control lines are run through grommets in the sail. The grommets are disposed in horizontal alignment in respective "cars", which are the means by which the luff of a mainsail is slidingly attached to the mast. Each row of grommets is spaced 2 to 3 feet (in a mainsail for a 36' boat) apart from each other going up the mast. Equidistant between each pair of successive horizontal rows of grommets and the respective cars aligned therewith there is a batten, a strip of fiberglass or wood, which fits within a pocket in the sail. Such battens run parallel to the boom and extend from the leading edge (luff) to the trailing edge (leech) of the sail. The control lines run through successive vertically aligned grommets so as to lie alternately on one side and then the other side of the sail.

As the sail is dropped, the control lines force the sail to be folded at the locations of the battens, successive battens being disposed on opposite sides of the boom. The control line or lines prevent the sail from falling off the boom. A key element of the system is the use of full length battens to force the sail to fold neatly on alternate sides of the boom. The battens can also allow for greater amounts of sail area, thus improving sail performance. It is to be understood that the principle of the invention can be applied to various types of sails, including mainsails, and jibs.

The sail control system of the invention is very simple, easy to use, inexpensive, and trouble-free. It can easily be adapted to an existing sail with minimum modifications, and will employ the existing boom, and reefing system of the boat whereby the effective sail area may be optionally reduced.

The invention will be more readily understood upon reference to the accompanying drawings, in which:

FIG. 2 is a view in side elevation on an enlarged scale of a sail such as that of FIG. 1, said sail, however, being provided with a second embodiment of sail control system employing two sail control lines, the sail being shown in a position in which it is partially dropped from its fully raised position on the mast;

FIG. 3 is a fragmentary view in end elevation of a portion of the sail as it is shown in FIG. 2, the view taken from along the line 3—3 in FIG. 2.

Figure 1:
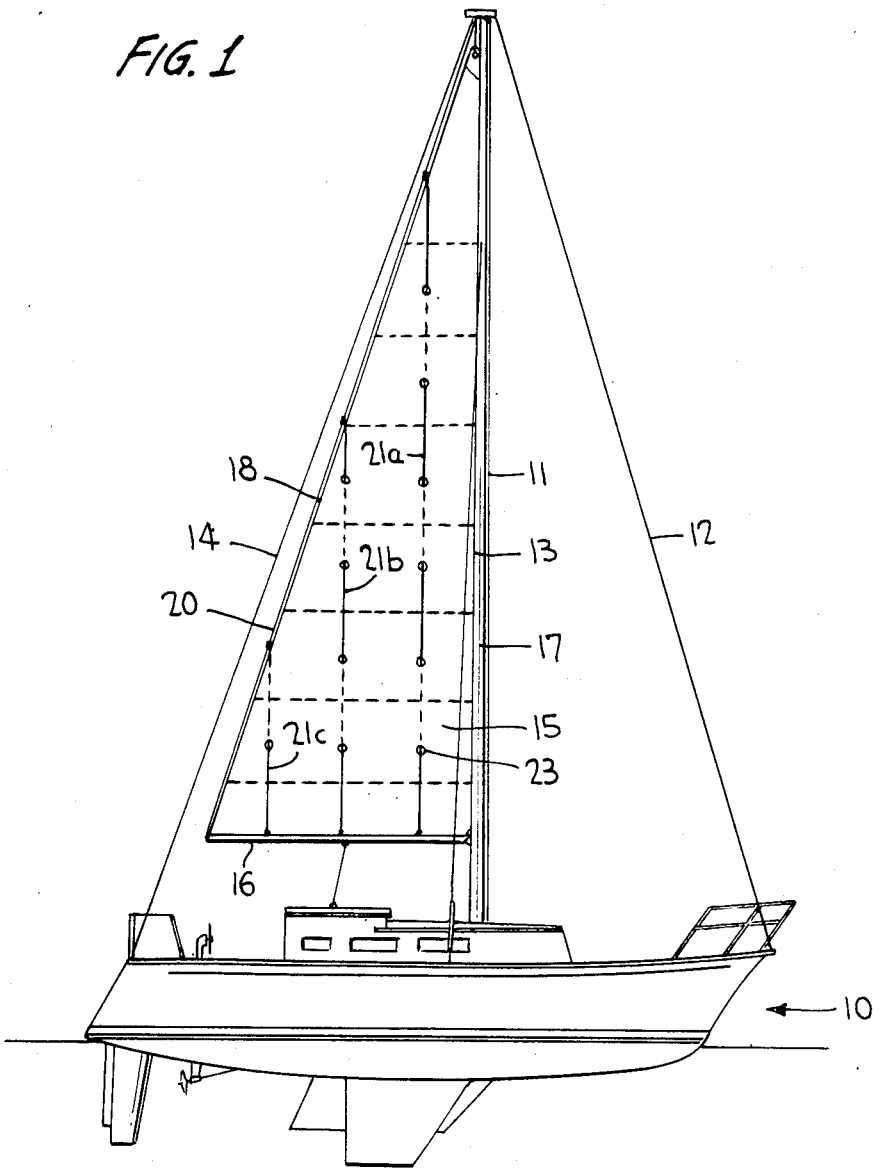
FIG. 1 is a view in side elevation of a sloop with its main sail fully raised, the mainsail being provided with a first embodiment of sail control system in accordance with the invention, such system incorporating three sail control lines.

Turning first to FIG. 1, an auxiliary powered sloop 10 is provided with a mast 11, the mast being braced by a forestay 12 and a backstay 14, as well as by side stays (not shown). A mainsail 15 has its foot attached to the boom 16, the forward edge or luff of sail 15 being slidably attached to the mast 11 by a plurality of spaced slidable attaching members known as "cars", not specifically shown in FIG. 1.

Sail 15, which is flexible and in this case is made of fabric, is provided with a plurality of battens 26 which extend throughout the full length of the distance between the leading edge or luff 13 of sail 15 to the trailing edge or leech 18 of the sail. In a preferred embodiment, the battens are disposed in pockets sewed into the sail and spaced by at least substantially equal distances vertically of the sail. Between the successive battens and at equal distances therebetween there are disposed horizontal rows of grommets 23. The horizontal rows of grommets are disposed in alignment with respective cars 17. The grommets are also disposed in three vertical rows, as shown.

A topping lift 20, that is, a line, extends from the outer end of the boom to the top of the mast. A plurality of control lines 21*a*, 21*b*, and 21*c*, three in the case of the embodiment of FIG. 1, are attached at their upper ends to the topping lift 20 and are threaded through the respective vertical rows of grommets 23 so as to lie alternately on one side and then on the other side of the sail 15. It will be seen that the three control lines all lie on the same side of the sail in alternate vertically spaced zones thereof and on the other side of the sail in the zones intermediate such first zones.

Turning now to FIG. 2, wherein a second embodiment of sail control systems employing two control lines is illustrated, the sail control system of the present invention is shown in greater detail than in FIG. 1. The reference characters are employed to designate elements in FIG. 2 which are the same as those or similar to those of FIG. 1.

In FIG. 2, the forward control line is designated 21a and the rear control line is designated 21*b*. The points of attachment of control lines 21*a* and 21*b* to the topping lift are designated 24 and 25, respectively. In FIG. 2, which illustrates a condition in which the sail 15 is either being dropped or raised, the lower end of the sail above the boom 16 is shown partially folded on top of the boom, with the battens, alternately lying on opposite sides of the boom.

In FIG. 3, a lower panel, which is designated $P_2$ is shown partially folded in a direction to the left, whereas the panel $P_1$ immediately thereabove, is shown being folded in the direction to the right. Such folding is dictated by the disposition of the control lines 21 and 21*b* in successive vertically spaced zones thereof alternately on the right and left side of the sail 15.

As the sail is dropped, it will fold, or flake, itself, the lines of folding lying along the battens. These battens in the folded sail will lie on alternate sides of the boom. The side of the boom on which the battens lie is determined by the control lines. If the batten is on the right side of the control lines, it will lie on the right side of the boom, and vice versa; in principle, the sail is folded to an accordion or a jacobs ladder.

With the sail control system of the invention, fewer people are needed to sail the boat. The system is quite inexpensive, (for a 30′ boat, it would cost under $500) and allows better sail shape and a greater sail area, thus yielding better said performance. The system allows the sails to be jiffy reefed easily by using the sails existing jiffy reefing system for the sails, unlike other mainsail furling systems such as those prior art furling systems described above. This system of the invention produces better sail shape when the sail is reefed in high winds then do prior art type furling systems. Such fact, along with the simplicity of the system of the present invention, makes it safer to use. It is to be understood, that although the sail control system of the invention has been described in connection with the main sail, the system can also be used to advantage with a foresail or a jib.

Figure 4:
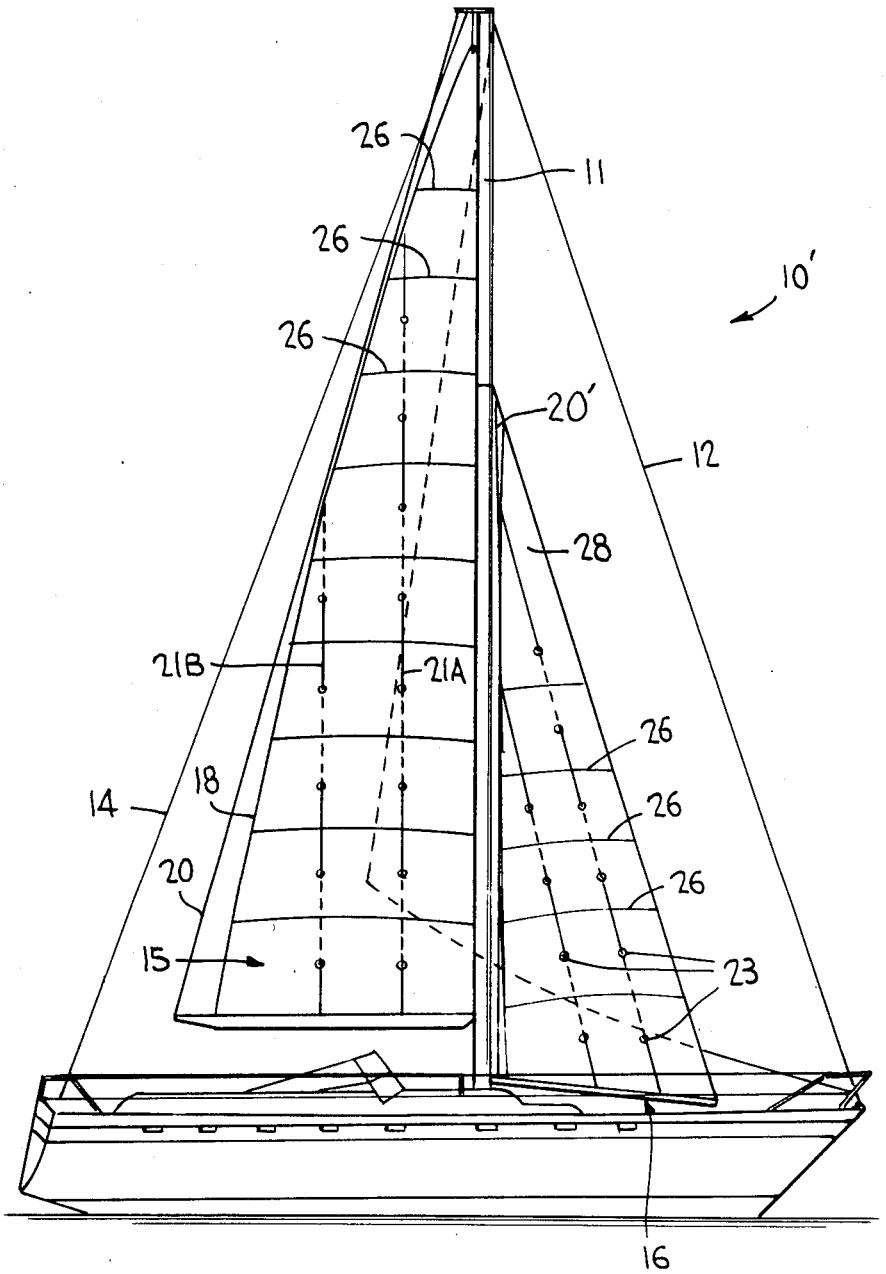
FIG. 4 is a view in side elevation of a cutter with raised main sail and jib, both sails being provided with a sail control system of the invention.

In FIG. 4 there is shown a cutter 10′ with a raised main sail and stay jib, both sails being provided with a sail control system in accordance with the invention. Parts in FIG. 4 which are the same as or similar to those in FIGS. 1–3, incl., are designated by the same reference characteristics as in FIGS. 1–3.

Although the invention is described and illustrated with reference to a plurality of embodiments thereof, it is to be expressly understood that it is in no way limited to the disclosure of such preferred embodiments but is capable of numerous modifications within the scope of the appended claims.

I claim:

1. A sail control system for use with a sailboat having a mast, a boom extending from the mast and terminating at an outer end, a flexible sail made of fabric secured to the boom and having an edge slidable along the mast, and a topping-lift connected to the outer end of the boom and the top of the mast , said sail control system including a plurality of spaced holes in the sail arranged in a substantially vertical row and a control line fixed at one end adjacent the boom and at an opposite end to the topping-lift at a position aligned with said row of spaced holes, said control line passing through said holes such that said control line is positioned alternately on opposite sides of the sail whereby when the sail is dropped, successive folds will be formed in the sail in opposite directions and will collect on the boom.

2. A sail control system as recited in claim 1 including a plurality of substantially vertical rows of holes in the sail in substantially parallel relation, said holes being horizontally aligned in rows in substantially parallel relation with the boom to define panels between successive horizontal rows, and a plurality of control lines each control line fixed at one end adjacent the boom and at an opposite end to the topping-lift and passing through said holes in a respective one of said substantially vertical rows to be positioned alternately on opposite sides of successive panels of the sail.

3. A sail control system as recited in claim 2 wherein the said has a luff edge and said substantially vertical rows of holes are disposed substantially parallel to said luff edge of the sail.

4. A sail control system as recited in claim 2 wherein said control lines are fixed to the boom.

5. A sail control system as recited in claim 2 wherein the sail includes a plurality of sliding members connecting the edge of the sail with the mast, each of said sliding members being aligned with one of said horizontal rows of holes.

6. A sail control system as recited in claim 2 and further comprising a plurality of vertically spaced battens fixed to the sail and extending horizontally across the sail at positions intermediate said horizontal rows of holes.

7. A sail control system as recited in claim 6 wherein successive ones of said battens are disposed on opposite sides of successive panels of the sail.

8. A method of flaking a flexible fabric sail slidably supported on a mast of a sailboat having a boom and a topping-lift connected with an outer end of the boom and the top of the mast comprising the steps of forming a substantially vertical row of spaced holes in the sail;

passing a control line fixed at one end adjacent the boom and at an opposite end to the topping-lift through the substantially vertical row of holes such that the control line is alternately disposed on opposite sides of the sail between successive holes; and lowering the sail causing the sail to successively fold in opposite directions and collect on the boom.

9. A method of flaking a fabric sail as recited in claim 8 wherein said hole forming step includes forming a plurality of substantially vertical rows of holes in the sail in substantially parallel relation, and said control line passing step includes fixing a plurality of control lines at one end adjacent the boom and at an opposite end to the topping-lift and passing each control line through one of the substantially vertical rows of holes to be alternately disposed on opposite sides of the sail between successive holes.

* * * * *